US006171119B1

(12) United States Patent
Phillips et al.

(10) Patent No.: US 6,171,119 B1
(45) Date of Patent: Jan. 9, 2001

(54) MODULE CONNECTOR PROTECTION CAP

(75) Inventors: David Anthony Phillips, Schoharie; Robert Kenneth Chapman, West Winfield, both of NY (US)

(73) Assignee: Amphenol Corporation, Wallingford, CT (US)

( * ) Notice: Under 35 U.S.C. 154(b), the term of this patent shall be extended for 0 days.

(21) Appl. No.: 09/223,975

(22) Filed: Dec. 31, 1998

(51) Int. Cl.[7] ..... H01R 439/149
(52) U.S. Cl. ..... 439/149; 439/509
(58) Field of Search ..... 439/149, 150, 439/135, 892, 144, 509

(56) References Cited

U.S. PATENT DOCUMENTS

| | | | |
|---|---|---|---|
| 2,544,654 | 3/1951 | Brown | 206/46 |
| 2,545,762 | 3/1951 | Brown | 206/46 |
| 3,407,264 | 10/1968 | Cull | 174/138 |
| 4,197,945 | 4/1980 | Sherwood | 206/328 |
| 4,417,095 | 11/1983 | Beun | 174/52 |
| 4,806,112 | 2/1989 | Roberts et al. | 439/144 |
| 4,913,663 * | 4/1990 | Siemon et al. | 439/509 |
| 4,943,693 | 7/1990 | Wang et al. | 200/304 |
| 4,944,685 | 7/1990 | Schulte | 439/135 |
| 4,986,772 | 1/1991 | Fukutani | 439/892 |
| 5,026,295 | 6/1991 | Fong et al. | 439/135 |
| 5,055,073 | 10/1991 | Yamada et al. | 439/892 |
| 5,106,313 | 4/1992 | Lwee et al. | 439/135 |
| 5,215,474 | 6/1993 | Rotella | 439/149 |
| 5,338,211 | 8/1994 | Kodama et al. | 439/135 |

* cited by examiner

*Primary Examiner*—Neil Abrams
*Assistant Examiner*—Michael C. Zarroli
(74) *Attorney, Agent, or Firm*—Blank Rome Comisky & McCauley, LLP

(57) ABSTRACT

A protection cap for an electrical connector with several terminals extending from a first end thereof. The cap includes a body having a cavity for releaseably receiving a second end of the connector which is opposite the first end, at least one arm extending from the body for wrapping partially around the connector, and a terminal retainer arranged on the free end of the arm for engaging at least some of the terminals.

15 Claims, 4 Drawing Sheets

MODULE CONNECTOR PROTECTION CAP

BACKGROUND OF THE INVENTION

1. Field of the Invention

The present invention generally relates to retainers for the terminals on an electrical connector, and, more particularly, to a cap for protecting the terminals on an electrical connector module during shipping, storage, and installation.

2. Description of Related Art

FIG. 1 illustrates a typical connector module 2 fitted with a conventional tie bar 4 on the ends of the terminals, or contact tails, 6 for protecting the terminals during shipping and storage, and for maintaining tail registration and co-planarity during installation of the connector 2 onto a circuit board. The tie bar 4 is preferably made from brass in order to allow it to be easily fitted to the terminals 6 and to minimize the effects of static electricity on the connector module 2.

During manufacturing, the tie bar 4 is crimped onto the end of the terminals 6 with pliers or other crimping tools. During subsequent installation of the connector, the terminals 6 are soldered to a circuit board, or other device, with the tie bar 4 in place. The free ends of the terminals 6 between the solder connection and the tie bar 4 are then trimmed in order to remove the tie bar 4 and terminal stubs from the soldered connection.

SUMMARY OF THE INVENTION

Such conventional tie bars have several drawbacks. For example, they are not reusable. The narrow width of the tie bar 4 also prevents it from adequately covering the entire length of the terminals 6 while the crimping process can otherwise bend or stress the terminals. Furthermore, since the tie bar 4 is fixed to the ends of the terminals 6, it can only be removed by pulling the terminals against the solder or trimming the ends of the terminals after the connector module 2 has been soldered onto the board. Often the connector module 2 must be installed in an inconvenient position relative to other components on the board. Consequently, removing the tie bar 4 after the connector 2 has been installed requires a significant amount of time and skill to complete without damaging the connector module 2.

These and other drawbacks associated with the prior art are addressed by providing a protection cap for an electrical connector having a plurality of terminals extending from one side of one end. The cap includes a body having a cavity for releasably receiving a second end of the connector which is opposite from the first end. At least one arm extends from the body for wrapping partially around the connector. A terminal retainer is then arranged on the free end of the arm for engaging and at least some of the connector terminals.

The cap may be formed from a contiguous sheet of material having hinges or folds which rotatably separate the body, arm, and terminal retainers from each other. The terminal retainer may include a plurality of wells, slots, holes, or terminal receiving cavities which each receive and protect one, or more, of the terminals. These slots may also extend all the way through the walls of the terminal retainer for providing access to the terminals through a wall in the retainer.

In another embodiment, the cap may further include means for releasably securing the terminal retainer to the connector. For example, the securing means may include a fastener arranged on the side or top of the terminal retainer for attaching to the side or top of the connector. The fastener may include a tab, latch, snap-clamp, adhesives, or other easily-releaseable devices. Alternatively, the terminal retainer may be secured to the connector without a fastener by the frictional force created between the terminals and the walls of the slots inside the terminal retainer.

BRIEF DESCRIPTION OF THE SEVERAL VIEWS OF THE DRAWINGS

The invention will now be described with respect to the following drawings wherein the numerals have been used to identify the similar features in each of the figures, and wherein.

DETAILED DESCRIPTION OF THE PREFERRED EMBODIMENTS

Figure 1:
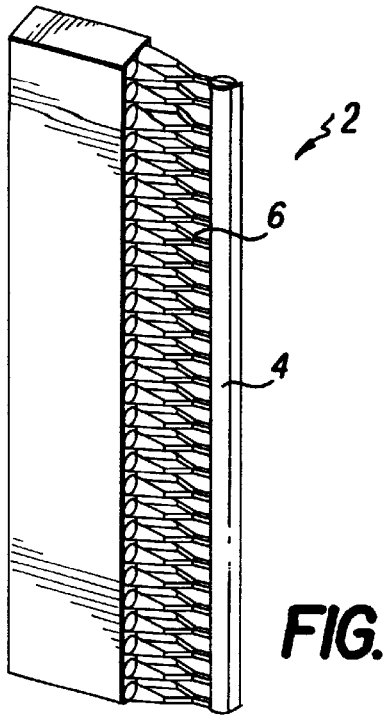
FIG. 1 (PRIOR ART)
FIG. 1 is an isometric view of a connector module with a conventional tie bar.
Figure 3:
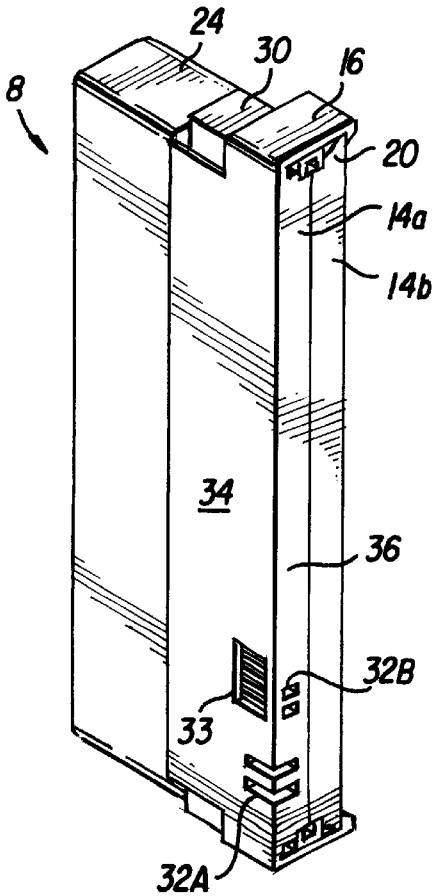
FIG. 3 is an isometric view of a connector module and protection cap assembly with the protection cap closed.
Figure 2:
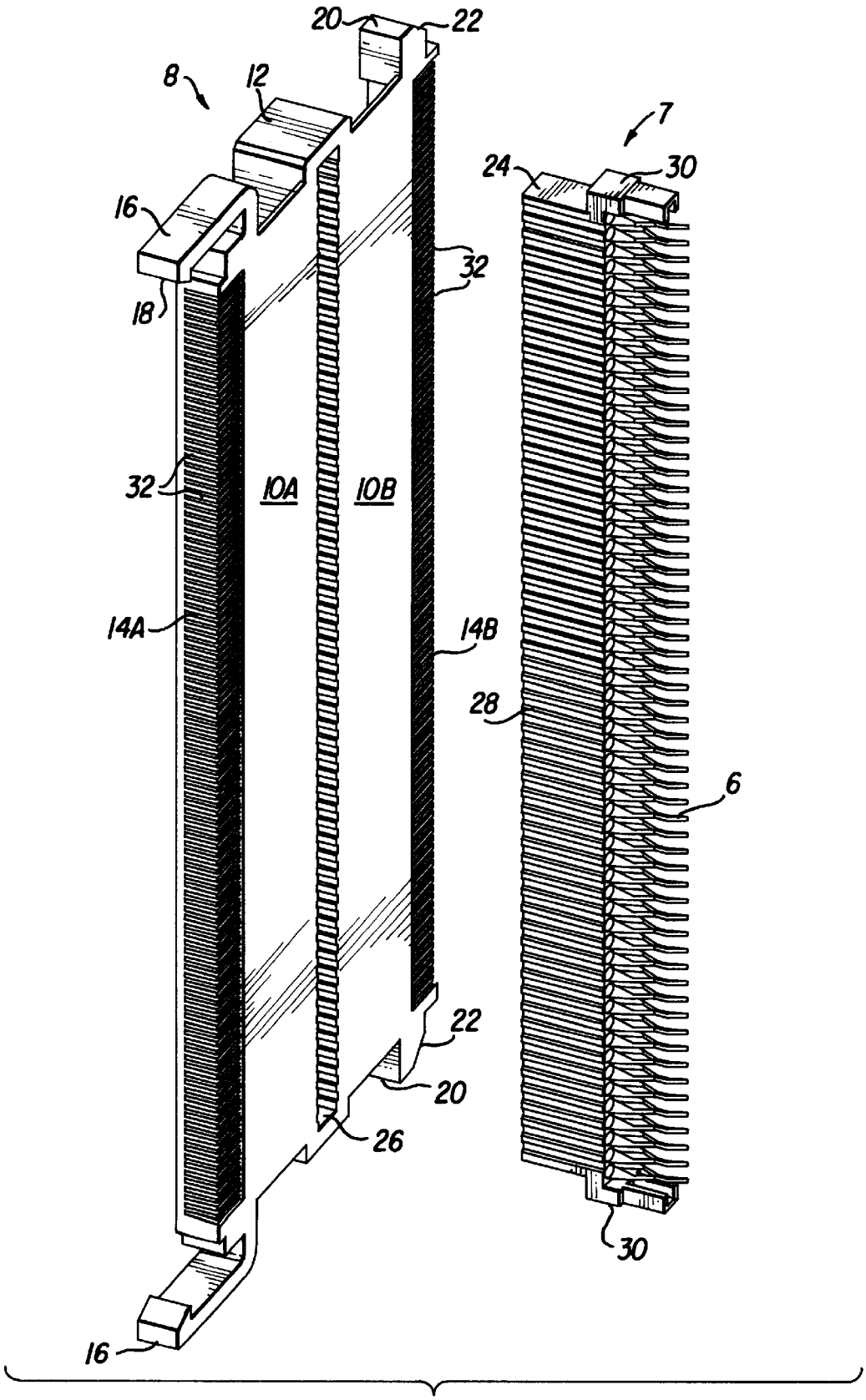
FIG. 2 is an exploded isometric view of a connector module and protection cap assembly with the protection cap open.

FIGS. 2 and 3 illustrate an assembly including a connector module 7 and a protection cap 8. Although a variety of other connector modules could be used with the protection cap, the connector module 7 shown in FIGS. 2 and three is particularly well-suited.

In FIG. 2, the protection cap 8 is in an open configuration where the arms 10A and 10B on each side of a body 12 are fully extended from the sides of the body. The arms 10 form a living, flexible hinge which may be creased or scored to help control its movement. Other hinging devices may also be used.

Each arm 10 is provided with a terminal retainer 14 on its free end. The terminal retainer 14A on arm 10A has a securing means or fastener 16 on each end of the terminal retainer 14A. Although each of the fasteners 16 are illustrated in the drawings as tabs or latch-type fasteners having a barb 18 which engages a corresponding post 20 on the opposite terminal retainer 14B, a variety of other releaseable fasteners may also be used, such as hook and loop fasteners, snaps, buckles, and/or adhesives. In a preferred embodiment, the post 20 includes an inclined surface 22 for urging the barb 18 over the top of the post 20 and allowing the fastener 16 to snap into place when the terminal retainers 14A and 14B are secured together in a closed configuration as described in more detail below and shown in FIG. 3.

As noted above, FIG. 2 also illustrates one embodiment of a connector module 7 which is particularly well suited for use with the protection cap 8. However, a variety of other connectors with terminals may also be used. The connector module 7 includes a housing 24 which is preferably sized to fit snugly inside the cavity 26 in the protection cap 8. In a preferred embodiment, the top and bottom surfaces of the housing 24 are provided with a ridge and trough pattern 28 which corresponds to a similar pattern in the side walls of the cavity 26 for use in aligning the housing 24 inside the cavity 26. A variety of other surface patterns and/or alignment devices may also be used.

The connector module 7 also preferably includes two T-shaped shoulders 30 arranged on each end of the housing 24 and extending over the terminals 6. As illustrated in FIG. 3 showing the connector module 7 assembled inside of the protection cap 8, the tab 16 on each end of the terminal retainer 14A slides over the top of the shoulders 30 on the connector module 7 and latches against the post 20 on the end of the terminal retainer 14B. In the closed configuration shown in FIG. 3, the terminals 6 are hidden from view and protected inside the cap 8 where they are pressed between the terminal retainers 14A and 14B.

In a preferred embodiment, the terminal retainers 14A and 14B are provided with a plurality of slots, wells, or contact tail cavities 32 which each receive one terminal from the connector module 2. Each slot 32 may also receive more than one terminal 6, or no terminals at all, depending upon the number of slots 32 and terminals 6. As is alternatively shown in FIG. 3, the slots 32 may also be in the form of holes 32A and/or 32B which extend through the top walls 34 and side walls 36 of the terminal retainers 14A and/or 14B for providing access to the terminals 6 through the walls. In addition, a window 33 may be provided in the walls 34 and/or 36. Although the openings 32A, 32B, and 33 are shown on only one portion of the walls 34 and 36 in terminal 14A, they may also be arranged along the entire portion of one or both walls 34, 36, and/or along any portion of the corresponding outer walls in the other terminal retainer 14B. Such holes and/or windows provide a visual inspection path which is useful for inspecting the terminals 6 while the assembly is in a closed configuration in order to ensure that each slot 32 receives the proper terminal and that terminals are not missing from the connector module 7.

In a preferred embodiment, the protection cap 8 is molded out of plastic, such as an amorphous thermoplastic polyethermide (PEI) resin like Ultem 1000™ brand unreinforced, available from GE Plastics, or an equivalent thereof. Other materials and different plastics may also be used. However, the material is preferably chosen so that the arms 10 form living hinges which may plastically, and/or elastically, deform when the protection cap is closed, but do not fracture or otherwise catastrophically fail during closure, or when the protection cap is reopened and the connector module 7 is removed. Although the protection cap 8 is illustrated as being formed from a single material, different materials, or composite materials, may also be used for different parts of the cap.

Figure 4:
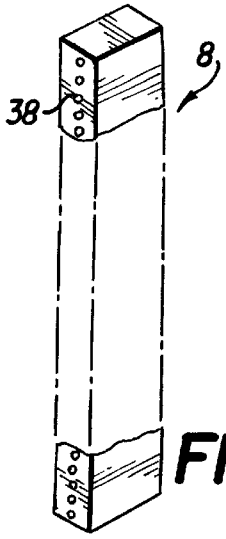
FIGS. 4 through 15 are isometric views of alternative embodiments for a protection cap.

FIGS. 4 through 15 illustrate other embodiments for a protection cap 8 which were considered while completing the preferred embodiments illustrated in FIGS. 2 and 3. In FIG. 4, the protection cap 8 is formed from a solid block and has a plurality of holes 38 in one side for receiving the ends of the terminals 6 in the connector module 7. This embodiment is preferably used with connector modules having terminals which are substantially straight so as to more easily fit inside the holes 38. Nonetheless, in this embodiment, the terminals 6 (not shown) can be difficult to align with the holes 38.

In another embodiment (not shown), the tips of the terminals 6 may be covered with a disposable coating material such as an epoxy or a plastic resin (including thermoplastic injection molded resins), putty, or sealant so as to mold a box, plate, or other shape, over the ends of the terminals. The terminals may also be covered with a tape. With such embodiments, the terminals 6 do not have to be aligned with any openings in the protection cap 8 as shown in FIG. 4. Prior to installation of the connector module 2, the coating or tape could be mechanically, thermally, an/or chemically removed from the terminals, or the protected terminals could be soldered to the board and then trimmed in order to remove the coated portions from the ends of the terminals.

Figure 5:
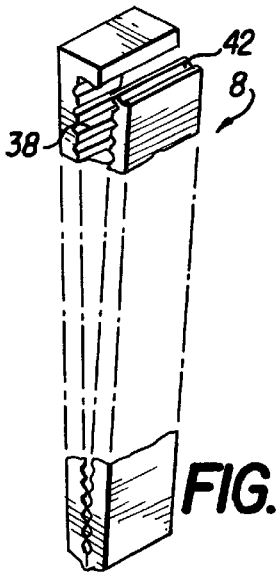

FIG. 5 shows a protection cap 8 which is similar to the protection cap shown in FIG. 4 except that it has a hinge 40 arranged at one end and a latch 42 at the other for securing the two halves together. In FIG. 5, the holes 38 extend through the protection cap 8. This configuration allows the terminals 6 to be more easily positioned inside the holes 38 before each half of the device is latched together. The hinge 40 is preferably a live hinge consisting of a thin piece of material joining the two halves.

Figure 7:
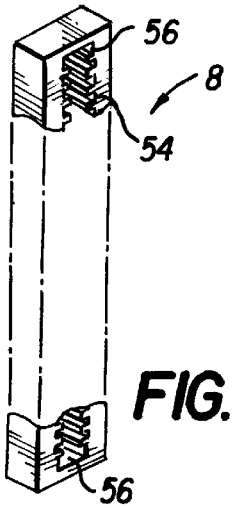
Figure 6:
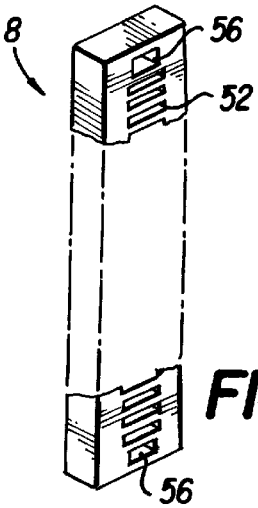

FIGS. 6 and 7 illustrate an embodiment for a protection cap 8 which is similar to the embodiment shown in FIG. 5 except that the holes 38 have been replaced with slots 52 in FIG. 6 and teeth 54 in FIG. 7. In addition, the embodiments shown in FIGS. 6 and 7 have been provided with openings 56 on each end for securing to the shoulders 30 on each end of the connector module 7 (not shown in FIGS. 4–15).

Figure 8:
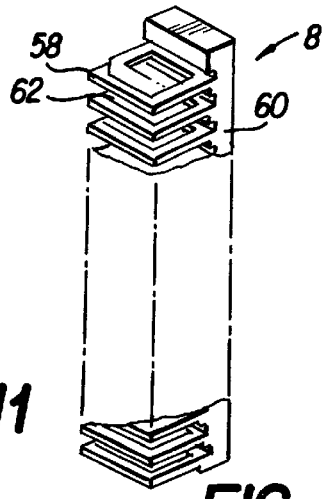

FIG. 8 illustrates another embodiment where dividers 58 extend between the terminals 6. A groove 60 is arranged on one side of each divider 58 near the top of the divider and a tab 62 is arranged on the other side of each divider near the bottom for support the outside edges of two adjacent terminals 6. The grooves 60 and tabs 62 may also be arranged on the same sides of the dividers 58.

Figure 9:
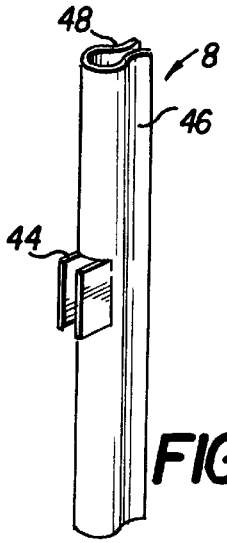
Figure 10:
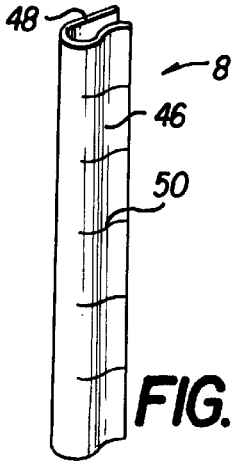

FIG. 9 illustrates another embodiment for a protection cap 8 in the form of a flexible clip including two handles 44 for opening the clip to receive the terminals 6 on the module connector 7. The front side 46 and back side 48 the clip-type protection cap shown in FIG. 9 are preferably formed to match the contours of the terminals 6. FIG. 10 illustrates an alternative embodiment for a clip in which the back face 48 may be formed in a different shape, such as substantially planar, while the front face 46 maintains substantially the same contour as the terminals 6. Other curve shapes may also be used. The front face 46 of the clip-type protection cap shown in FIG. 10 is divided by a plurality of slits 50 for increasing the flexibility of the front face 46. The slits 50 eliminate the need for any handles, such as handles 44 in FIG. 6, in order to open the clip. However, handles may also be provided for each section which is separated by the slits 50.

Figure 11:
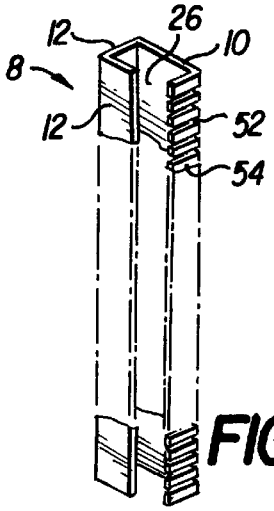

FIGS. 11 through 15 illustrate various embodiments for a protection cap 8 which is formed from a contiguous sheet of material having hinged, folded edges. In FIG. 11, the left and rear walls of the sheet form body walls or surfaces 12 which are separated from, and hinged to, the arm wall or surface 10 by a fold. A second fold separates and hinges the arm wall 10 from the terminal retainer wall or surface 14. Other types of hinge mechanisms may also be used.

The terminal retainer wall 14 in the embodiment shown in FIG. 11 includes flexible teeth 54 formed by slots 52 in the front edge of the wall. The teeth 54 may also be rigid. The body walls 12, arm wall 10, and terminal retainer wall 14 wrap around a cavity space 26 for receiving and supporting a connector module 7 inside the cavity with the terminals 6 (not shown) extending through the slots 52 between the teeth 54 in the terminal wall 14.

Figure 12:
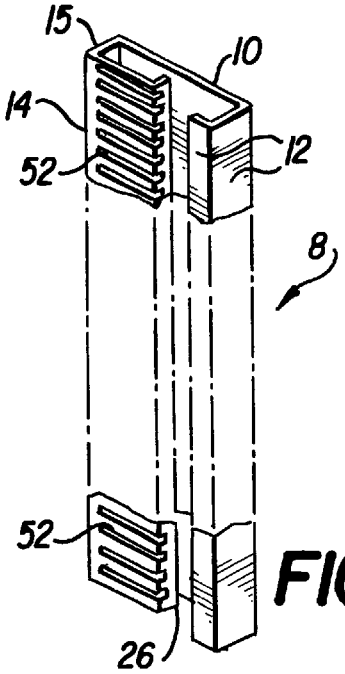
Figure 14:
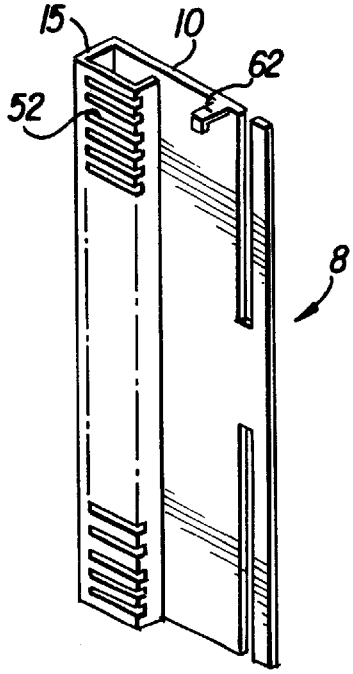
Figure 13:
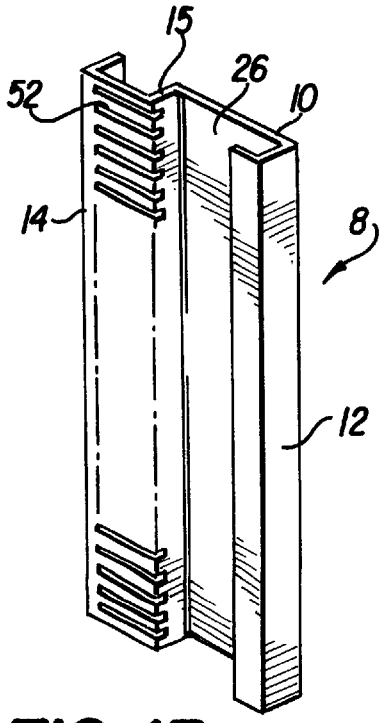
Figure 15:
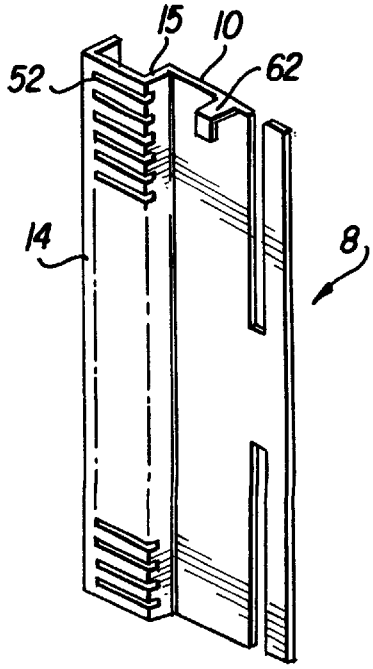

In the contiguous sheet embodiment shown in FIGS. 12 and 14, the arm wall 10 and terminal retainer wall 14 are separated by additional wall 15 and an additional fold or hinge for providing greater flexibility in arranging the terminals 6 (not shown) inside the slots 52. The slots 52 may be lengthened so that they extend to the edge of the retaining wall 14 so as to form rigid or flexible teeth (not shown) for separating the terminals 6. In the embodiments shown in FIGS. 13 and 15, the terminal retaining walls 14 are folded in the opposite direction for allowing the protection cap 8 to accommodate wider connectors in the cavity 26. In FIGS. 14 and 15, the body wall 12 has been replaced with a finger or tab fastener 62 for securing the connector module 7 against the arm wall 10 and accommodating thicker connectors. The tab 62 may be an adhesive tab and/or may extend farther underneath the arm wall 10.

Although described with respect to preferred embodiments of the invention, it should be readily understood that various changes and/or modifications may be made without departing from the spirit of the invention. In general, the invention is only intended to be limited by the scope of the following claims.

What is claimed is:

1. A protection cap for an electrical connector with a plurality of terminals extending from a first side thereof, said cap comprising:

a body having a cavity for releaseably receiving a second side of the connector which is opposite the first side;

at least one arm extending from the body to wrap around at least a portion of the connector;

the arm comprising a terminal retainer arranged on a free end of the arm to engage at least one of the terminals.

2. The cap recited in claim 1, wherein said arm is hinged to the body and said terminal retainer is hinged to the arm.

3. The cap recited in claim 2, wherein said body, arm, and terminal retainer are formed from a contiguous sheet.

4. The cap recited in claim 3, wherein said body, arm, and terminal retainer are hinged by a fold in said sheet.

5. The cap recited in claim 1, wherein said terminal retainer includes a plurality of slots, each slot for receiving a receiving a terminal.

6. The cap recited in claim 5, wherein each of said slots includes an opening extending through said terminal retainer for providing access to the terminals through a wall of the terminal retainer.

7. The cap recited in claim 1, further comprising means for securing the terminal retainer to the connector.

8. The cap recited in claim 7, wherein said securing means includes a releaseable fastener.

9. The cap recited in claim 8, wherein said fastener includes a latch arranged on an end wall of said terminal retainer.

10. A protection cap for an electrical connector with a plurality of terminals extending from a first side thereof, said cap comprising:

a body having a cavity for releaseably receiving a second side of the connector which is opposite the first side;

at least one arm extending from, and hinged to, the body to wrap around at least a portion of the connector;

a terminal retainer hinged to the free end of the arm to engage at least one of the terminals, said terminal retainer including a plurality of slots, each slot for receiving a receiving a terminal; and a device for securing the terminal retainer to the connector.

11. The cap recited in claim 10, wherein said body, arm, and terminal retainer are formed from a contiguous sheet.

12. The cap recited in claim 11, wherein said body, arm, and terminal retainer are hinged by a fold in said sheet.

13. The cap recited in claim 10, wherein each of said slots includes an opening extending through said terminal retainer for providing access to the terminals through a wall of the terminal retainer.

14. The cap recited in claim 10, wherein said securing device includes a releaseable fastener.

15. The cap recited in claim 14, wherein said fastener includes a latch arranged on an end of said terminal retainer.

* * * * *